US009992579B2

(12) United States Patent
Albahri et al.

(10) Patent No.: US 9,992,579 B2
(45) Date of Patent: Jun. 5, 2018

(54) INTEGRATED YOKE AND ARMATURE IN A RECEIVER

(71) Applicant: Knowles Electronics, LLC, Itasca, IL (US)

(72) Inventors: Shehab Albahri, Hanover Park, IL (US); Ya-hui Zhang, Suzhou Industrial Park (CN)

(73) Assignee: Knowles Electronics, LLC, Itasca, IL (US)

( * ) Notice: Subject to any disclaimer, the term of this patent is extended or adjusted under 35 U.S.C. 154(b) by 0 days. days.

(21) Appl. No.: 15/170,516

(22) Filed: Jun. 1, 2016

(65) Prior Publication Data

US 2016/0360319 A1 Dec. 8, 2016

Related U.S. Application Data

(60) Provisional application No. 62/170,366, filed on Jun. 3, 2015.

(51) Int. Cl.

| | |
|---|---|
| ***H04R 1/00*** | (2006.01) |
| ***H04R 11/02*** | (2006.01) |
| *H04R 31/00* | (2006.01) |

(52) U.S. Cl.

CPC ..... *H04R 11/02* (2013.01); *H04R 31/00* (2013.01); *H04R 2499/11* (2013.01)

(58) Field of Classification Search

CPC ..... H04R 11/02; H04R 25/00
USPC ..... 381/418
See application file for complete search history.

(56) References Cited

U.S. PATENT DOCUMENTS

| | | | |
|---|---|---|---|
| 3,935,398 | A | 1/1976 | Carlson et al. |
| 4,901,293 | A | 2/1990 | Kuhn |
| 5,193,116 | A | 3/1993 | Mostardo |
| 5,177,383 | A | 5/1993 | Sim |
| 5,418,414 | A | 5/1995 | Ackermann et al. |
| 5,647,013 | A | 7/1997 | Salvage et al. |

(Continued)

FOREIGN PATENT DOCUMENTS

| | | | |
|---|---|---|---|
| CN | 203872027 | U | 10/2014 |
| CN | 204118999 | U | 1/2015 |

(Continued)

OTHER PUBLICATIONS

"Rare-Earth Permanent Magnets, VACODYM VACOMAX"; Internet Article; XP-002317685; www.vacuumschmelze.de; 2003.

(Continued)

*Primary Examiner* — Sunita Joshi
(74) *Attorney, Agent, or Firm* — Faegre Baker Daniels LLP

(57) ABSTRACT

An integrated armature and yoke for an acoustic receiver is disclosed. The armature includes a generally u-shaped member having a first portion arranged substantially parallel to a second deflecting portion. The yoke includes a central portion connected to the first portion, and first and second wall portions extending from opposite sides of the central portion toward the second deflecting portion. In a receiver, the second portion of the integrated armature and yoke is disposed through a receiver coil and extends into a space between permanent magnets, wherein an excitation signal applied to the coil causes the second deflecting portion of the armature to deflect between the magnets and to drive an acoustic sound generating diaphragm.

20 Claims, 7 Drawing Sheets

(56) References Cited

U.S. PATENT DOCUMENTS

| | | | | |
|---|---|---|---|---|
| 5,960,093 | A | 9/1999 | Miller | |
| 6,041,131 | A | 3/2000 | Kirchhoefer et al. | |
| 6,150,911 | A | 11/2000 | Katznelson et al. | |
| 6,600,400 | B1 | 7/2003 | Andou et al. | |
| 6,909,613 | B2 | 6/2005 | Augustijn et al. | |
| 7,362,878 | B2 | 4/2008 | Miller et al. | |
| 2002/0136425 | A1 | 9/2002 | Warren | |
| 2003/0190053 | A1 | 10/2003 | van Halteren | |
| 2013/0315436 | A1* | 11/2013 | Miller | H04R 11/02 381/418 |

FOREIGN PATENT DOCUMENTS

| | | | |
|---|---|---|---|
| CN | 204119001 | U | 1/2015 |
| CN | 205595998 | U | 9/2016 |
| CN | 205596265 | U | 9/2016 |
| WO | 2015057519 | A1 | 4/2015 |

OTHER PUBLICATIONS

International Search Report; Application No. PCT/US04/018570; dated Mar. 11, 2005.

"Carpenter High Permeability "49" Alloy"; Carpenter Specialty Alloys; 1992.

"Standard Specifications for Permanent Magnet Materials"; MMPA Standard No. 100-00; Magnetic Materials Producers Association; 1964.

"Soft Magnetic Cobalt-Iron-Alloys, VACOFLUX 48 VACOFLUX 50 VACODUR 50 VACOFLUX 17"; Internet Article; XP002317686; www.vacuumschmelze.de; 2001.

* cited by examiner

INTEGRATED YOKE AND ARMATURE IN A RECEIVER

CROSS REFERENCE TO RELATED APPLICATION

This patent claims benefit under 35 U.S.C. § 119 (e) to U.S. Provisional Application No. 62/170,366 entitled "Integrated Yoke and Armature in Receiver" filed Jun. 3, 2015, the content of which is incorporated herein by reference in its entirety.

TECHNICAL FIELD

This application relates to acoustic receivers or speakers, and more particularly to acoustic receivers that vibrate a diaphragm with a deflecting armature.

BACKGROUND

Various types of acoustic devices have been used over the years. One type of acoustic device is a receiver having a deflecting armature. Such a receiver typically includes a coil, diaphragm, bobbin, stack, among other components contained within a receiver housing. Other types of acoustic devices may include other types of components. A motor of the receiver typically includes the coil, a yoke, such as a stack, and the armature, which together form a magnetic circuit.

In operation, an electrical signal creates a changing magnetic field that moves the armature relative to permanent magnets. The armature moves a drive rod, which moves a diaphragm to produce sound presented to a listener. The yoke provides a support structure for the magnets and in some cases provides portions of the magnetic flux path created when the receiver is operated.

Receivers are use in various electronic devices such as cellular phones, hearing aids, personal computers, and tablets. As the years have progressed, it has become desirable to make these electronic devices smaller. One limitation in making the electronic devices smaller is that when receivers are included, the size of the yoke often necessitates a larger device. The problems of previous approaches have resulted in some user dissatisfaction with these previous approaches as further miniaturization has become difficult to achieve.

BRIEF DESCRIPTION OF THE DRAWINGS

For a more complete understanding of the disclosure, reference should be made to the following detailed description and accompanying drawings wherein.

Figure 1:
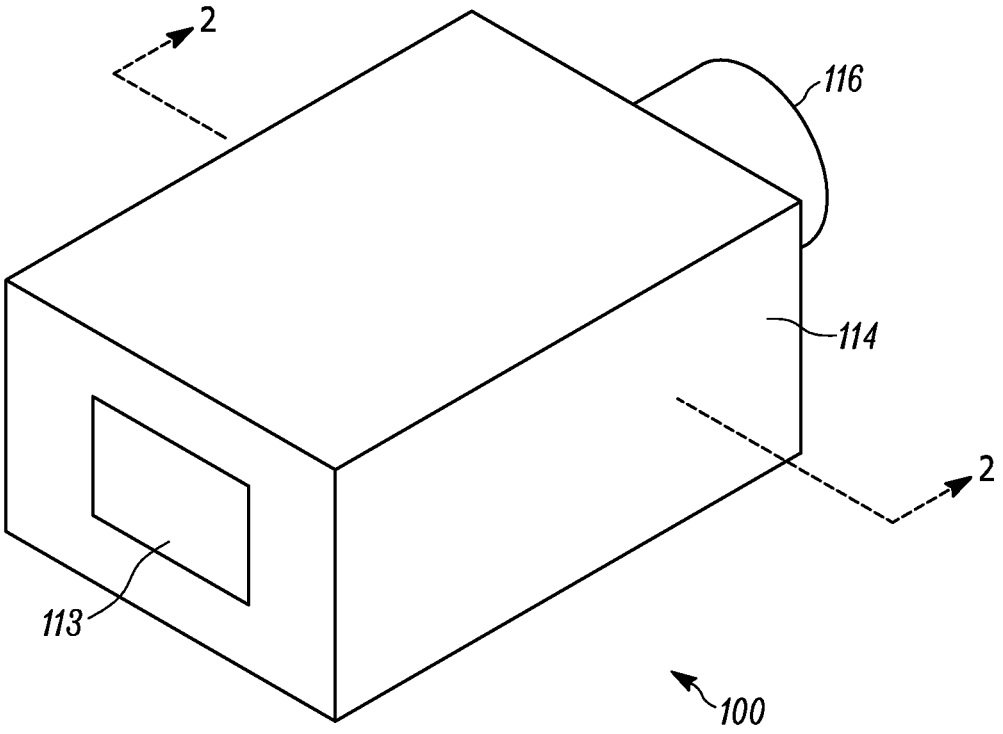
FIG. 1 is a perspective diagram of a receiver.

Those of ordinary skill in the art will appreciate that elements in the figures are illustrated for simplicity and clarity. It will be further appreciated that certain actions and/or steps may be described or depicted in a particular order of occurrence while those of ordinary skill in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The present disclosures relates to an integral yoke and armature for, and within, an acoustic receiver (speaker) assembly. In one example, the yoke includes wings and is folded backward to provide a full enclosure. The embodiments provided herein form a shorter device (compared to previous approaches) and eliminate an interface in the magnetic flux path. The teachings of the present disclosure advantageously lessen distortion and increase the efficiency of the magnetic circuit created in the receiver.

Referring now to FIGS. 1-6, one example of a receiver 100 is described. The receiver 100 includes an integrated armature and yoke (or stack) 104, a rod 106, a coil 108, magnets 110, a diaphragm 112, a case 114, and sound tube 116.

As shown, the integrated armature and yoke 104 is created from a single-piece of material, such as a metallic material. The material may be magnetically conductive. The single-piece of material is folded to have a central portion 123, a pair of spaced wall portions 202, 204 depending from the central portion 123, and two wings 120 and 122 extending transversely away from the wall portions 202, 204. The wings 120 and 122 are coupled to the case 114. An armature portion 121 extends into the coil 108 and moves in the presence of changing magnetic flux. The armature portion 121 couples to the rod 106 and the rod 106 couples to the diaphragm 112. Consequently, applying current to the coil 108 creates a changing magnetic field, which moves the armature portion 121, which moves the drive rod 106, which moves the diaphragm 112 to create sound energy in a front volume of the housing or case 114. The front volume communicates with the sound tube 116. In this way, electrical energy is converted into sound energy.

Figure 2:
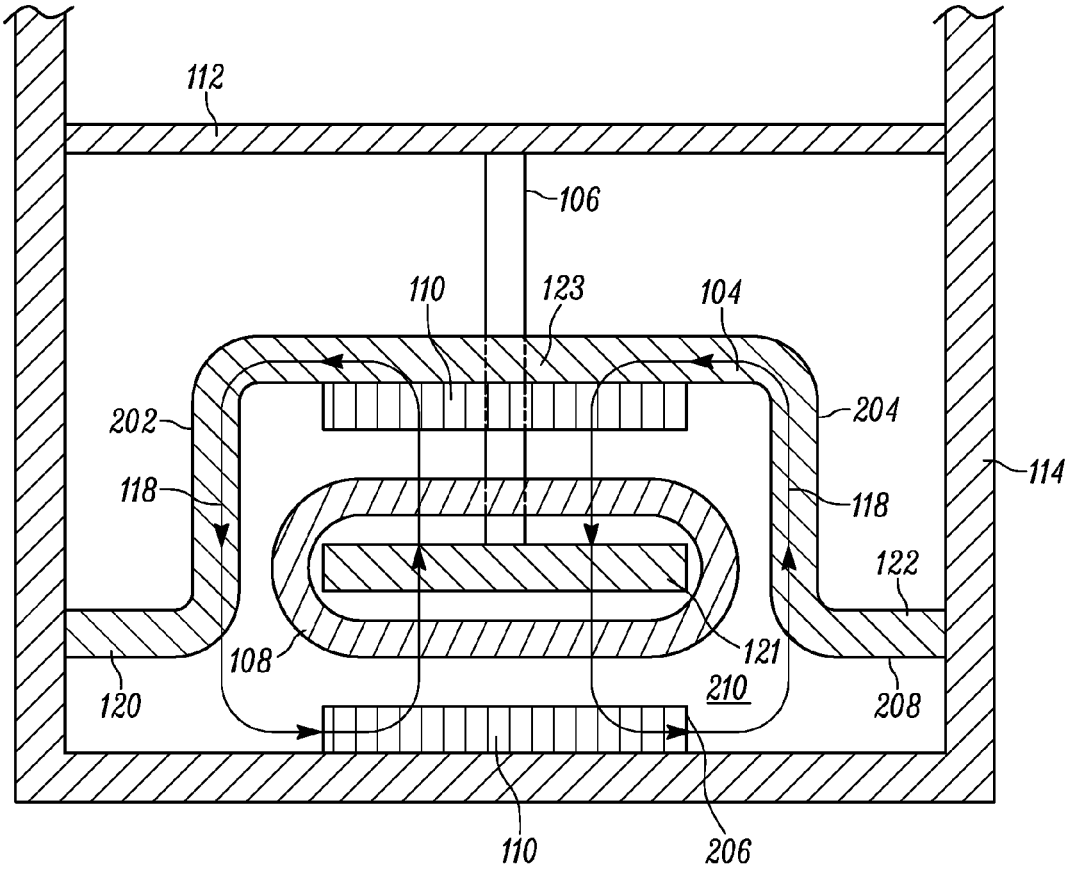
FIG. 2 is a cross-sectional view of the receiver taken across line 2-2 in FIG. 1.
Figure 3:
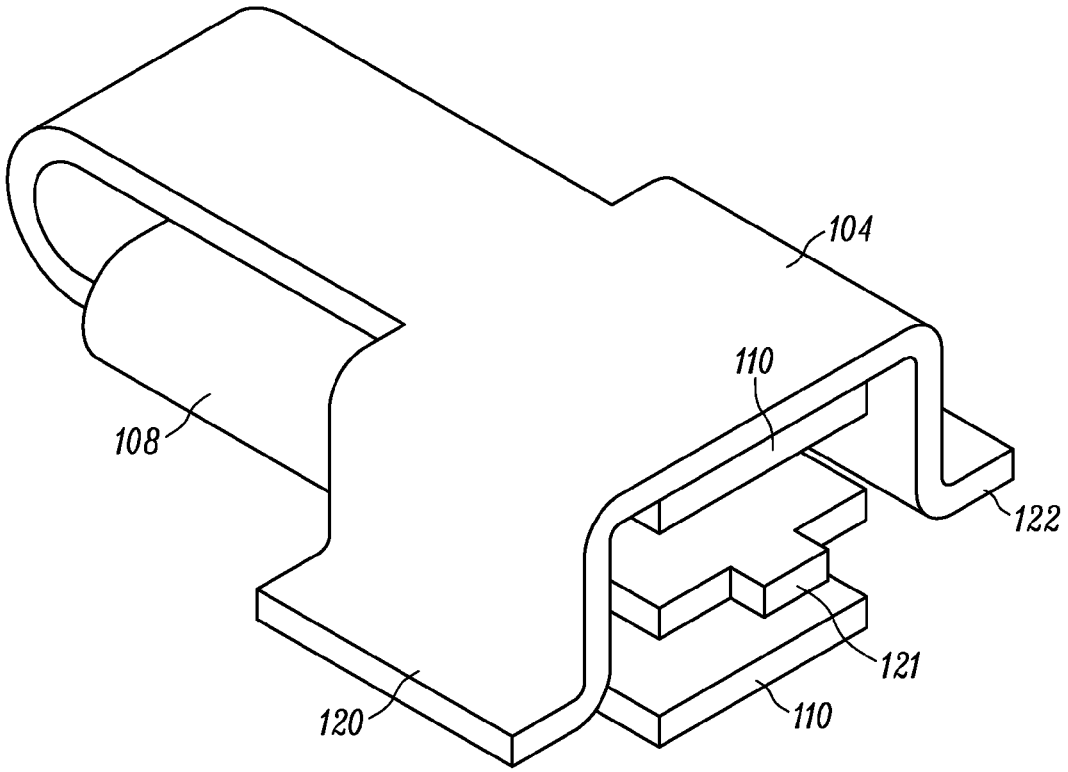
FIG. 3 is a perspective view of portions of the receiver of FIG. 1 and FIG. 2.
Figure 4:
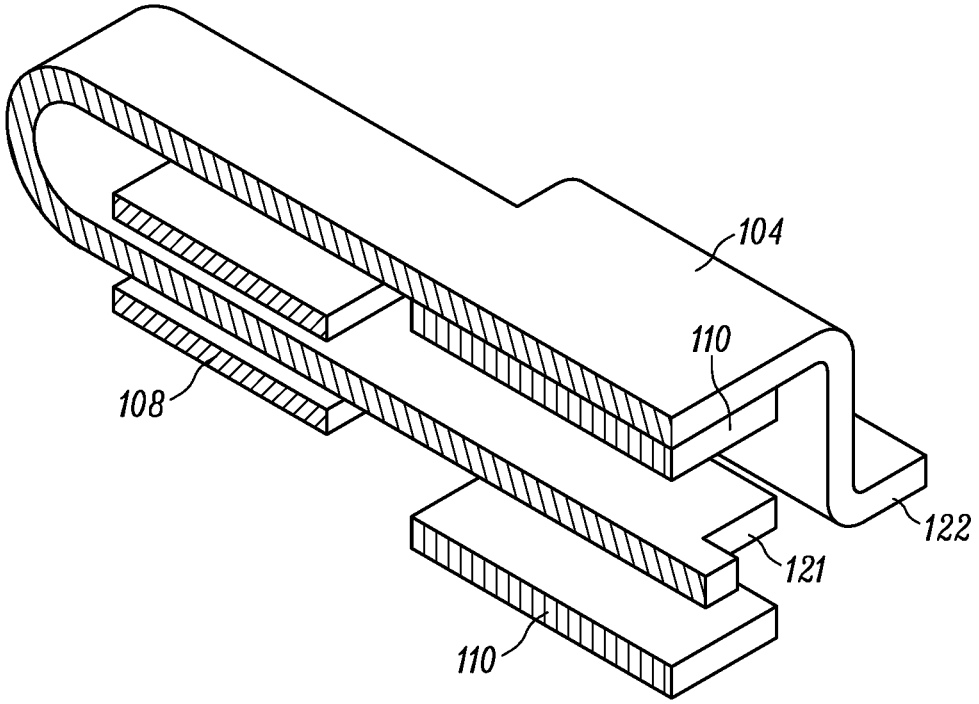
FIG. 4 is a cross-sectional perspective view of the portions of the apparatus of FIG. 3.
Figure 5:
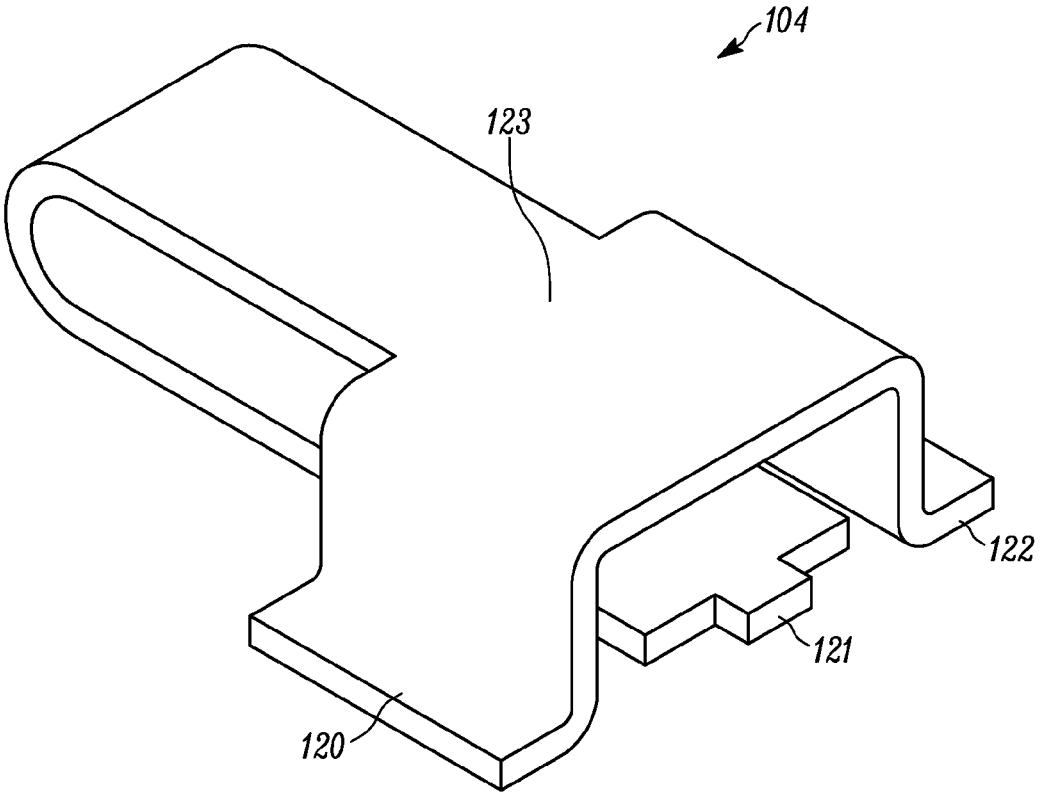
FIG. 5 is a perspective view of the integrated yoke and armature of FIGS. 1-4.
Figure 6:
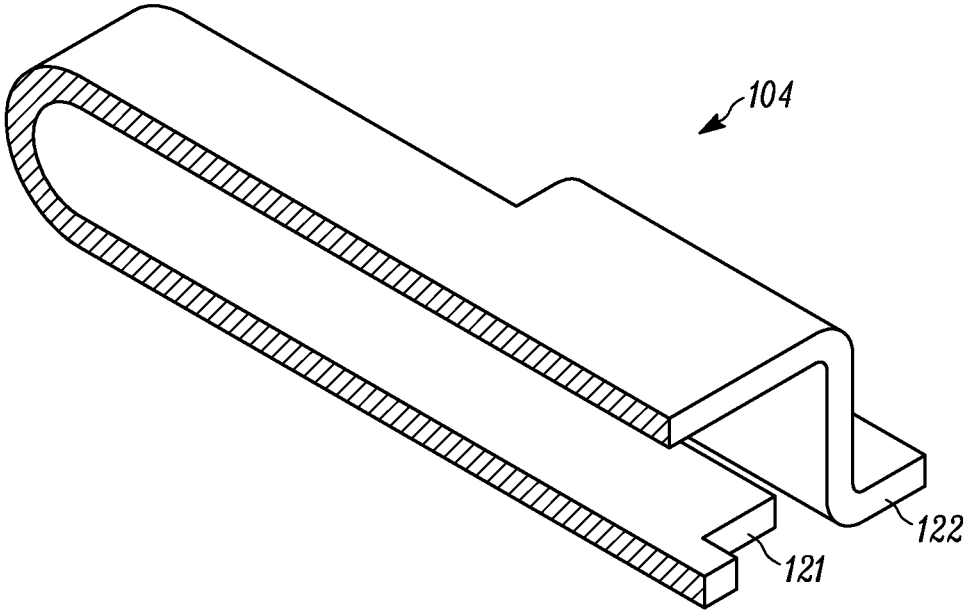
FIG. 6 is a cross-sectional perspective view of the integrated yoke and armature of FIG. 5.

A magnetic flux path 118 is established in the receiver. The magnetic flux path 118 extends from the wall portions 202, 204 2 of integrated armature and yoke 104 to the central portion 123, through the magnets 110 and the armature portion 121, and back to the wing portions 120, 122. With reference to FIG. 2, there is an interface 206 between air 210 within the case 114 and one of the magnets 110 and an interface 208 between the wing 122 and the air 210 (similar interfaces are present between the one magnet 110, the air 210, and the wing 120). The magnetic flux may thereby travel directly from the one magnet 110 to the wings 120, 122 through the air 210 without traveling through any structures or other materials.

It will be appreciated that the present approaches include one less interface than previous approaches. More specifically, previous approaches had an interface between a separate armature and a separate yoke. In the present approaches, this interface is eliminated since the armature and yoke are integrated together from a single-piece of material. This results in better system performance (e.g., less distortion) because of the reduction of the number of interfaces in the magnetic flux path. The integration of the two components also results in a smaller device.

Figure 7:
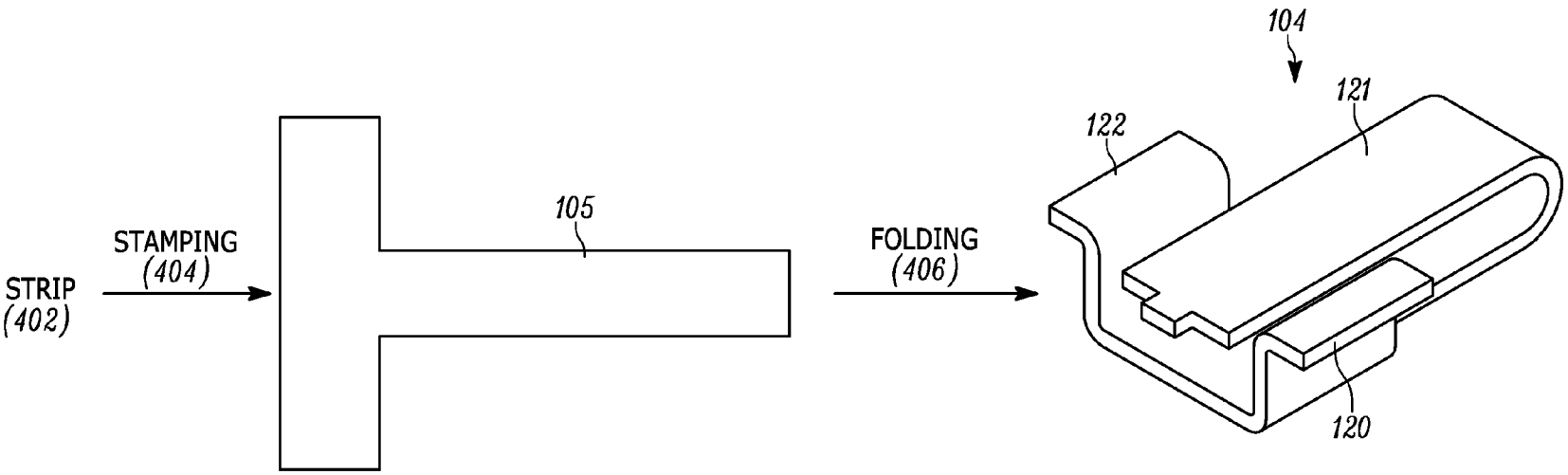
FIG. 7 is diagram showing steps for manufacturing an integrated yoke and armature.

Referring now to FIG. 7, one example of an approach for constructing an integrated armature and yoke (or stack) 104 is described. At a first step 402 a strip of material is obtained. At a second step 404, the material is stamped to obtain a shape 105. Then, at step 406 folding occurs resulting in the integrated armature and yoke (or stack) 104. This integrated component can be disposed in a receiver. In this way, reed fabrication tooling time and expense are saved and there is no need for a welding process (as was utilized in previous approaches).

In one example of the operation of the system of FIGS. 1-6, electrical current (e.g., from an external source) is applied to the coil 108 via connectors 113. This creates a changing magnetic field, which moves the armature portion 121 of the integrated armature and yoke (or stack) 104, which moves the drive rod 106, which moves the diaphragm 112 to create sound energy in a front volume. The front volume communicates with the sound tube 116.

It will be appreciated that the present approaches are described where a single motor arrangement is disposed in the receiver. However, it will be understood that the present approaches can be extended to multiple motor arrangements. In one example, multiple motors are used with each of the motors independently producing sound. The motors share the sound tube 116, in this example.

Preferred embodiments of this disclosure are described herein. It should be understood that the illustrated embodiments are exemplary only, and should not be taken as limiting the scope of the appended claims.

What is claimed is:

1. An acoustic receiver comprising:

a coil;

a single-piece of material comprising an integrated armature and a yoke, the armature including a generally u-shaped member, the yoke including a central portion and a wall portion extending from the central portion;

a first magnet and a second magnet, the first magnet supported by the yoke, a portion of the armature extending through the coil and between the first magnet and the second magnet;

a housing enclosing the coil, the integrated armature and yoke, the first magnet, and the second magnet, the second magnet fastened to the housing, wherein electrical current excites the coil and causes a changing flux that moves the armature between the first magnet and the second magnet.

2. The receiver of claim 1, the generally u-shaped member of the armature including a first portion and a second portion substantially parallel to the first portion, the second portion extending through the coil and between the first magnet and the second magnet.

3. The receiver of claim 2, the central portion of the yoke connected to the first portion of the armature, the yoke includes a pair of wall portions, the pair of wall portions extending from opposite sides of the central portion of the yoke, the pair of wall portions located in a different plane than the central portion of the yoke, the first magnet supported by the central portion between the pair of wall portions of the yoke.

4. The receiver of claim 1, the generally u-shaped member of the armature including a first portion and a second portion substantially parallel to the first portion, the second portion extending through the coil and between the first magnet and the second magnet.

5. The receiver of claim 4, the central portion of the yoke disposed in a common plane with a portion of the armature.

6. The receiver of claim 3, the pair of wall portions each including a wing portion extending laterally from the corresponding wall portion, the wing portions coupled to the housing.

7. The receiver of claim 6, the central portion of the yoke disposed in a common plane with the first portion of the armature.

8. The receiver of claim 1, the armature coupled to a sound-producing diaphragm by a linkage, wherein movement of the armature moves the sound-producing diaphragm.

9. The receiver claim 1, the integrated armature and yoke comprises a magnetically conductive material.

10. An acoustic receiver comprising:

a coil;

a magnetically conductive element formed of a single-piece of material, the magnetically conductive element having a generally u-shape with a first portion and a second portion;

a first magnet and a second magnet, the first magnet supported by the first portion of the magnetically conductive element, the second portion of the magnetically conductive element extending through the coil and movably disposed in a space between the first magnet and the second magnet; and a magnetic circuit comprising the first portion of the magnetically conductive element, the first magnet, the second portion of the magnetically conductive element, and the second magnet.

11. The receiver of claim 10, wherein the magnetically conductive element is an integrated armature and yoke formed of a single-piece of material.

12. The receiver of claim 11, the yoke includes a central portion in a common plane with the first portion of the magnetically conductive element, the yoke includes wall portions extending from opposite sides of the central portion, the wall portions located in a different plane than the central portion of the yoke, the first magnet supported by the central portion between the wall portions of the yoke, the magnetic circuit further comprising the wall portions of the magnetically conductive element.

13. The receiver of claim 12, each wall portion of the yoke including a wing portion extending laterally from the corresponding wall portion, each wing portion coupled to a housing of the acoustic receiver.

14. The receiver of claim 10, the second portion of the magnetically conductive element is coupled to a sound-producing diaphragm by a linkage, wherein movement of the second portion moves the sound-producing diaphragm.

15. The receiver of claim 10, wherein the receiver is deployed in a cellular phone, a personal computer, a hearing aid or a tablet.

16. An integrated armature and yoke for an acoustic receiver, comprising:

a single-piece of material comprising an integrated armature and a yoke, the armature including a generally u-shaped member having a first portion arranged substantially parallel to a second deflecting portion, the armature including a portion interconnecting the first portion and the second deflecting portion, the yoke including a central portion connected to the first portion, the yoke including a first wall portion and a second wall portion, the first wall portion extending from a first lateral side of the central portion toward the second deflecting portion, and the second wall portion extending from a second lateral side portion, opposite the first lateral side portion, toward the second deflecting portion.

17. The integrated armature and yoke of claim 16, the central portion of the yoke having a width greater than a width of the first portion, the first wall portion and the second wall portion extending beyond the second deflecting portion.

18. The integrated armature and yoke of claim 16, each of the first and second wall portions of the yoke including a wing portion extending laterally from an end portion of the corresponding wall portion.

19. The integrated armature and yoke of claim 16 comprises a magnetically conductive material.

20. The integrated armature and yoke of claim 16, the single-piece of material comprising the integrated armature and the yoke is stamped from a sheet material and has a folded shape.

* * * * *